US009469468B2

(12) United States Patent
Shibata et al.

(10) Patent No.: US 9,469,468 B2
(45) **Date of Patent: *Oct. 18, 2016**

(54) AEROSOL CONTAINER FOR DISPENSING PLURAL KINDS OF LIQUIDS

(75) Inventors: Takuo Shibata, Tokyo (JP); Nobuyuki Hanai, Tokyo (JP); Ken Ogata, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 176 days.

This patent is subject to a terminal disclaimer.

(21) Appl. No.: 13/814,193

(22) PCT Filed: Dec. 2, 2010

(86) PCT No.: PCT/JP2010/071549

§ 371 (c)(1),
(2), (4) Date: Feb. 4, 2013

(87) PCT Pub. No.: WO2012/073361

PCT Pub. Date: Jun. 7, 2012

(65) Prior Publication Data

US 2013/0270294 A1 Oct. 17, 2013

(51) Int. Cl.

| | |
|---|---|
| ***B65D 35/22*** | (2006.01) |
| ***B65D 83/68*** | (2006.01) |
| ***B65D 83/48*** | (2006.01) |
| ***B65D 83/62*** | (2006.01) |
| ***B65D 83/38*** | (2006.01) |
| ***B65D 83/42*** | (2006.01) |
| *B65D 83/32* | (2006.01) |

(52) U.S. Cl.

CPC ..... *B65D 83/682* (2013.01); *B65D 83/38* (2013.01); *B65D 83/425* (2013.01); *B65D 83/48* (2013.01); *B65D 83/62* (2013.01); *B65D 83/68* (2013.01); *B65D 83/32* (2013.01)

(58) Field of Classification Search

CPC .... B65D 83/68; B65D 83/682; B65D 83/38; B65D 83/54; B65D 83/62

USPC ..... 222/94, 95, 402.1, 385, 135, 136, 137, 222/105, 635, 389, 402.2, 542, 386.5, 222/402.11, 402.14, 402.15, 402.23, 222/402.24, 402.25, 145.1, 145.5; 128/200.23

See application file for complete search history.

(56) References Cited

U.S. PATENT DOCUMENTS 2,941,696 A * 6/1960 Homm ..... 222/136
3,114,483 A * 12/1963 Kappel ..... B65D 83/48 222/402.2
3,313,459 A * 4/1967 Mizuguchi ..... 222/402.2

(Continued)

FOREIGN PATENT DOCUMENTS

JP H06-012856 Y 4/1994

*Primary Examiner* — Patrick M Buechner
*Assistant Examiner* — Randall Gruby
(74) *Attorney, Agent, or Firm* — Florek & Endres PLLC

(57) ABSTRACT

A mounting member fitted and mounted on an open head portion of an aerosol container having an inner diameter of 1 inch is formed with two or more valve housing mounting portions. The mounting member is fitted and mounted with the middle portion of this mounting member being located at a bead of the opening head portion of the aerosol container in such a manner that the upper portions of aerosol valves project upwardly from the opening head portion. A cover covering the outside of the mounting member is crimped to the outside of the bead in a manner to hold down a stem gasket and two or more aerosol valves are provided in the inch can.

6 Claims, 12 Drawing Sheets

(56) References Cited

U.S. PATENT DOCUMENTS 3,421,698 A * 1/1969 Baltzer ..... 239/304
3,455,489 A * 7/1969 Meshberg ..... 222/94
3,547,317 A * 12/1970 Green ..... 222/402.2
3,591,059 A * 7/1971 Stearns ..... B65D 83/54 222/402.2
3,608,782 A * 9/1971 Sathicq ..... 222/94
3,637,114 A * 1/1972 Meshberg ..... 222/135
3,672,543 A * 6/1972 Roper et al. ..... 222/183
3,680,740 A * 8/1972 Kinnavy ..... 222/129
3,813,013 A * 5/1974 Kotuby et al. ..... 222/402.2
3,931,912 A * 1/1976 Hsiung ..... 222/94
3,982,668 A * 9/1976 Riccio ..... 222/95
3,992,003 A * 11/1976 Visceglia et al. ..... 222/94
4,010,872 A * 3/1977 Lozano et al. ..... 222/94
4,189,069 A * 2/1980 Stoody ..... 222/83.5
4,407,481 A * 10/1983 Bolton et al. ..... 251/353
4,469,252 A * 9/1984 Obrist ..... 222/135
4,496,081 A * 1/1985 Farrey ..... 222/135
4,595,127 A * 6/1986 Stoody ..... 222/135
4,826,048 A * 5/1989 Skorka et al. ..... 222/137
4,953,759 A * 9/1990 Schmidt ..... B65D 83/54 222/402.2
4,969,577 A * 11/1990 Werding ..... B65D 83/14 141/3
5,167,347 A * 12/1992 Wiegner et al. ..... 222/94
5,622,282 A * 4/1997 Yazawa ..... B65D 83/38 222/105
5,632,421 A * 5/1997 Colombo ..... 222/402.2
5,901,883 A * 5/1999 Ritsche ..... 222/137
6,070,770 A * 6/2000 Tada et al. ..... 222/635
6,095,182 A * 8/2000 Warby ..... 137/375
6,098,846 A * 8/2000 Yazawa et al. ..... 222/95
6,341,717 B2 * 1/2002 Auer ..... 222/135
6,401,979 B1 * 6/2002 Mekata ..... B65D 83/62 222/1
6,419,168 B1 * 7/2002 Thieleke et al. ..... 239/337
6,454,140 B1 * 9/2002 Jinks ..... 222/402.2
6,474,513 B2 * 11/2002 Burt ..... 222/402.1
6,651,847 B2 * 11/2003 Mekata et al. ..... 222/105
6,736,288 B1 * 5/2004 Green ..... 222/94
6,832,704 B2 * 12/2004 Smith ..... 222/402.1
6,923,342 B2 * 8/2005 Bourque et al. ..... 222/136
6,968,982 B1 * 11/2005 Burns ..... 222/321.7
6,978,915 B1 * 12/2005 Russell ..... 222/402.2
7,036,685 B1 * 5/2006 Green ..... 222/94
7,481,334 B2 * 1/2009 Arghyris et al. ..... 222/137
7,798,366 B2 * 9/2010 Hoshino ..... 222/136
8,505,774 B2 * 8/2013 Nimmo ..... B65D 83/62 222/105
8,602,271 B2 * 12/2013 Winker ..... B65D 83/54 222/402.1
8,678,248 B2 * 3/2014 Davideit ..... B65D 83/546 222/402.2
2002/0074357 A1 * 6/2002 Karr et al. ..... 222/190
2003/0121935 A1 * 7/2003 Arsenault et al. ..... 222/1
2003/0178448 A1 * 9/2003 Warby et al. ..... 222/402.24
2006/0049278 A1 * 3/2006 Hoshino ..... 239/333
2006/0243753 A1 * 11/2006 Goujon et al. ..... 222/402.2
2009/0008584 A1 * 1/2009 Fontela et al. ..... 251/118
2013/0284759 A1 * 10/2013 Teramoto ..... B65D 83/384 222/94
2014/0008389 A1 * 1/2014 Mekata ..... B65D 83/20 222/94
2015/0344214 A1 * 12/2015 Yamaguchi ..... B65D 83/38 222/95

* cited by examiner

AEROSOL CONTAINER FOR DISPENSING PLURAL KINDS OF LIQUIDS

This application is a U.S. National Stage filing under 35 U.S.C. §371 of International Application No. PCT/JP2010/071549, filed Dec. 2, 2010.

TECHNICAL FILED

This invention relates to an aerosol container for dispensing plural kinds of liquids using an aerosol container having an inner bags diameter of 1 inch according to which plural kinds of liquids can be dispensed and injected separately from independent aerosol valve systems.

BACKGROUND ART

There are various types of aerosol products filled with contents liquids and propellant. Among them, there are products according to which an excellent function can be obtained by mixing plural kinds of contents. Such products include, for example, hair dyeing agent, coating, adhesives and pharmaceuticals.

Many of such substances which must be mixed before use cause chemical reaction such as hardening and oxidation by mixing and, therefore, when mixing is performed in an aerosol valve, there occurs a case wherein the aerosol valve cannot be reused due to oxidation, hardening or the like cause. In such a case, therefore, it is preferable to dispense and inject such contents outside instead of mixing them inside of the aerosol valve.

For this reason, in the two liquid dispensing aerosol device disclosed in Patent Literature 1 below, for example, different contents liquids are filled in two different inner bags by gas pressure, two passages respectively communicating with the inner bags are formed in a single aerosol valve and these two contents liquids are dispensed and injected from the valve stem.

In the aerosol valve device for dispensing plural kinds of liquid disclosed in Patent Literatures 2 and 3 below, a plurality of stem operation apertures are formed in a mounting cup mounted on an open head portion of an aerosol container, an aerosol valve is mounted on each of the stem operation apertures, an inner container is housed in an outer container and liquid to be treated contained in each of the inner container and the outer container is dispensed from the respective aerosol valves.

In the aerosol device disclosed in Patent Literature 4 below, two aerosol containers are connected together and a common injection button is attached to each valve stem provided in a mounting cup at the top end portion of each container and liquid to be treated in the two aerosol containers are separately injected up to the injection button, On the other hand, an aerosol container which is generally used as a standard type aerosol container of such aerosol product, there is one called "one inch can" which has an inner diameter of 1 inch, has a bead formed along the outer periphery of its open head portion, and is closed by fixing a mounting cup by, e.g., caulking.

PRIOR ART LITERATURE

Patent Literature 1: Japanese Patent Application Laid-open Publication No. 2004-244109

Patent Literature 2: Japanese Patent Application Laid-open Publication No. 2002-193363

Patent Literature 3: International Patent Publication WO02/34636

Patent Literature 4: Japanese Patent Application Laid-open Publication No. H10-86983

Problem to be Solved by the Invention

If it is intended to provide an aerosol product which can dispense and inject plural kinds of liquids filled in an aerosol container separately without mixing them by means of a so-called inch can which is often used as a standard type aerosol container, the aerosol device disclosed in Patent Literature 1 according to which two passages are formed in a single aerosol valve is compact and can be applied for such purpose but has the problem that it is necessary to form two passages in the aerosol valve which is made of a small piece of material and this makes the structure complicated and, moreover, when the stem is pushed down for injection, it is difficult to inject uniform amount of liquids from the two passages.

In the aerosol device disclosed in Patent Literatures 2 and 3 according to which the two aerosol valves are mounted on the mounting cup, when the mounting cup is fixed to the bead along the outer periphery of the open head portion of the aerosol container, it is necessary to cause an expandable pawl located in a recess formed inside of the outer periphery of the mounting cup to expand outwardly, In the so-called inch can, however, space for receiving the pawl for clinching cannot be secured and, accordingly, the device of Patent Literature 2 cannot be applied.

Further, when two or more aerosol valves are provided, the area of the stem gasket becomes twice or more and, as a result, the area of top ceiling surface to which internal pressure is applied will also become larger. Hence, means must be provided for coping with such problem.

Further, in a case where plural contents liquids such as a hair dye consisting of a first agent which is a strong alkali component and a second agent which is an acidic component having an oxidating property, it is necessary to fill and store such plural contents liquids in the aerosol container without causing reaction and without any trouble.

The present invention has been made for solving such problems of the prior art aerosol device. It is an object of the invention to provide an aerosol device for dispensing plural kinds of liquids which can dispose two or more aerosol valves in an aerosol container having a bead portion of an inner diameter of 1 inch which is frequently used as a standard type container and which can dispense and inject contents liquids separately without mixing.

It is also an object of the invention to provide an aerosol container for dispensing plural kinds of liquids which can prevent deformation due to increase in the area of a stem gasket portion caused by disposing two or more aerosol valves.

It is still another object of the invention to provide an aerosol container for dispensing plural kinds of liquids according to which a hair dye consisting of a first agent which is a strong alkali component and a second agent which is an acidic component having an oxidating property can be filled in a single aerosol container without any trouble.

Means for Solving the Problems

For solving these problems, an aerosol device for dispensing plural kinds of liquids of claim 1 comprises: an aerosol container having an open head portion having an inner diameter of 1 inch and formed with a bead around the open head portion; a plurality of aerosol valves housed in the aerosol container each having a stem through which contents liquid of each of the aerosol valves is injected outside; a mounting member which is fittedly mounted on the open head portion with a middle portion of the mounting member being located at the bead of the open head portion; a plurality of valve housing mounting portions provided in the mounting member each being capable of mounting the aerosol valves; and a cover covering the outside of the mounting member, holding a stem gasket and being fixed on the outside of the bead through a seal gasket, said stems of the aerosol valves projecting outwardly through the cover; wherein an aerosol propellant is filled in the aerosol container and an inner bag which can vary capacity of contents liquid filled therein is connected to each of the plurality of aerosol valves.

In an aerosol device of claim 2 comprises, in addition to the structure defined in claim 1, the inner bag is made of a pouch.

In an aerosol device of claim 3, in addition to the structure defined in claim 1, the aerosol device has two of the aerosol valves and the contents liquids consist of a hair dye which comprises a first agent and a second agent, and a first pouch constituting the inner bag filled with the first agent is connected to one of the aerosol valves and a second pouch constituting the inner bag filled with the second agent is connected to the other of the aerosol valves.

In an aerosol device of claim 4, in addition to the structure defined in any of claims 1-3, the stem of the plurality of aerosol valves is provided in such a manner that it can be recognized from outside.

In an aerosol device of claim 5, in addition to the structure defined in claim 4, the stem can be recognized by forming flat side walls and a curved side wall in a top portion of the mounting member.

In an aerosol device of claim 6, in addition to the structure defined in any of claims 1-5 a reinforcing cover member which is capable of holding the stem gasket and preventing deformation of the cover is provided between the mounting member and the cover.

In an aerosol device of claim 7, in addition to the structure defined in claim 6, holding means which is capable of holding the reinforcing cover member to the mounting member is provided between the reinforcing cover member and the mounting member.

In an aerosol device of claim 8, in addition to the structure defined in claim 6 or 7, a top end projecting portion formed in a substantially elliptical shape having parallel flat side walls is formed in the top portion of the mounting member and the reinforcing cover member covers the top end projecting portion.

In an aerosol device of claim 9, in addition to the structure defined in claim 8, the reinforcing cover member is provided with a bottom portion which covers, in addition to the top end projecting portion, the mounting member.

In this specification, contents liquids mean not only liquidus initial liquids which are filled in an aerosol container but also initial liquids in a state of jel, foam or cream.

Advantageous Results of the Invention

According to the aerosol device for dispensing plural kinds of liquids of claim 1, the aerosol device comprises: an aerosol container having an open head portion having an inner diameter of 1 inch and formed with a bead around the open head portion; a plurality of aerosol valves housed in the aerosol container each having a stem through which contents liquid of each of the aerosol valves is injected outside; a mounting member which is fittedly mounted on the open head portion with a middle portion of the mounting member being located at the bead of the open head portion; a plurality of valve housing mounting portions provided in the mounting member each being capable of mounting the aerosol valves; and a cover covering the outside of the mounting member, holding a stem gasket and being fixed on the outside of the bead through a seal gasket, said stems of the aerosol valves projecting outwardly through the cover wherein an aerosol propellant is filled in the aerosol container and an inner bag which can vary capacity of contents liquid filled therein is connected to each of the plurality of aerosol valves. Since plural valve housing mounting portions are formed in the mounting member fittedly mounted on the open head portion having an inner diameter of 1 inch and the aerosol valve is mounted in each of these valve housing mounting portions, sufficient space for mounting the aerosol valves can be secured as compared with the prior art mounting cup which clinches from the inside.

Further, since the mounting member is fittedly mounted with the middle portion of the mounting member being located at the bead of the open head portion, the upper portions of the aerosol valves project from the open head portion and the outside of the mounting member is covered with the cover which is fixed to the outside portion of the bead by caulking or the like in a manner to hold the stem gasket, plural aerosol valves can be provided in an inch can.

Further, since a propellant is filled in the aerosol container and an inner bag which can vary capacity of contents liquid filled therein is connected to each of the plurality of aerosol valves, each of the plurality of contents liquids can be dispensed and injected from the inner bag independently in a con-contacting state without influencing each other.

By this arrangement, each of the contents liquids can be filled in the inner bag of the aerosol container without influencing each other and contents liquids can be dispensed and injected separately without mixing from two or more aerosol valves and uniform amount of contents liquids or an amount of a predetermined ratio of contents liquids can be injected from each aerosol valve.

According to the aerosol device of claim 2, the inner bag is made of a pouch and, therefore, each contents liquid can be filled in the pouch of the aerosol container without influencing each other and contents liquids can be dispensed and injected from the aerosol valves connected to a plurality of pouches in separate state without mixing together. Further, a uniform amount of contents liquids or an amount of a predetermined ratio of contents liquids can be injected from each aerosol valve whereby an aerosol product can be manufactured easily and inexpensively.

According to the aerosol device of claim 3, the aerosol device has two of the aerosol valves and the contents liquids consist of a hair dye which comprises a first agent and a second agent, and a first pouch constituting the inner bag filled with the first agent is connected to one of the aerosol valves and a second pouch constituting the inner bag filled with the second agent is connected to the other of the aerosol valves. Therefore, the first agent and the second agent of the hair dye can be filled in the first pouch and the second pouch of the aerosol container without influencing each other and the first agent and the second agent of the hair dye can be dispensed and injected from the aerosol valves connected to the first pouch and the second pouch separately without mixing together. Further, a uniform amount of contents liquids or an amount of a predetermined ratio of contents liquids can be injected from each aerosol valve whereby an aerosol product can be manufactured easily and inexpensively.

According to the aerosol device of claim 4, the stem of the plurality of aerosol valves is provided in such a manner that it can be recognized from outside and, therefore, stems of a plurality of aerosol valves can be identified from outside by, for example, coloring the stems whereby different contents liquids can be filled in their respective inner bags accurately.

According to the aerosol device of claim 5, the stem can be recognized by forming flat side walls and a curved side wall in a top portion of the mounting member and, therefore, stems of a plurality of aerosol valves can be identified from outside by the shape of the flat side walls and the curved side wall in the top portion of the mounting member whereby different contents liquids can be filled in their respective inner bags accurately.

According to the aerosol device of claim 6, a reinforcing cover member which is capable of holding the stem gasket and preventing deformation of the cover is provided between the mounting member and the cover. By disposing the reinforcing cover member on the outside of the stem gasket, deformation and leakage from the stem gasket due to inner pressure applied to a ceiling portion of the cover can be accurately prevented.

By this arrangement, even when provision of two or more aerosol valves causes increase in the area of the stem gasket portion, deformation and leakage can be accurately prevented.

According to the aerosol device of claim 7, holding means which is capable of holding the reinforcing cover member to the mounting member is provided between the reinforcing cover member and the mounting member. By providing holding means such as a slit and a pawl which can engage each other, the reinforcing cover member can be held to the mounting member in an assembled state. By this arrangement, the cover can be fixed by, for example, crimping in the assembled state of the aerosol valves whereby manufacturing and assembling of the aerosol device can be facilitated.

According to the aerosol device of claim 8, a top end projecting portion formed in a substantially elliptical shape having parallel flat side walls is formed in the top portion of the mounting member and the reinforcing cover member covers the top end projecting portion. By covering the reinforcing cover member by forming the top end projecting portion formed in a substantially elliptical shape having parallel flat side walls in the mounting member, positioning can be facilitated by conducting assembling on the basis of the parallel flat side walls whereby the assembling work can be made efficiently and the filling process for filling contents liquids in the aerosol container can also be made efficiently.

According to the aerosol device of claim 9, the reinforcing cover member is provided with a bottom portion which covers, in addition to the top end projecting portion, the mounting member. By covering the whole of the top end projecting portion and the mounting portion by the reinforcing cover member by forming the bottom portion, the ceiling portion of the cover can be reinforced more accurately and deformation and leakage of contents liquids can be prevented.

EMBODIMENTS FOR CARRYING OUT THE INVENTION

Embodiments for carrying out the invention will now be described in detail.

Figure 1:
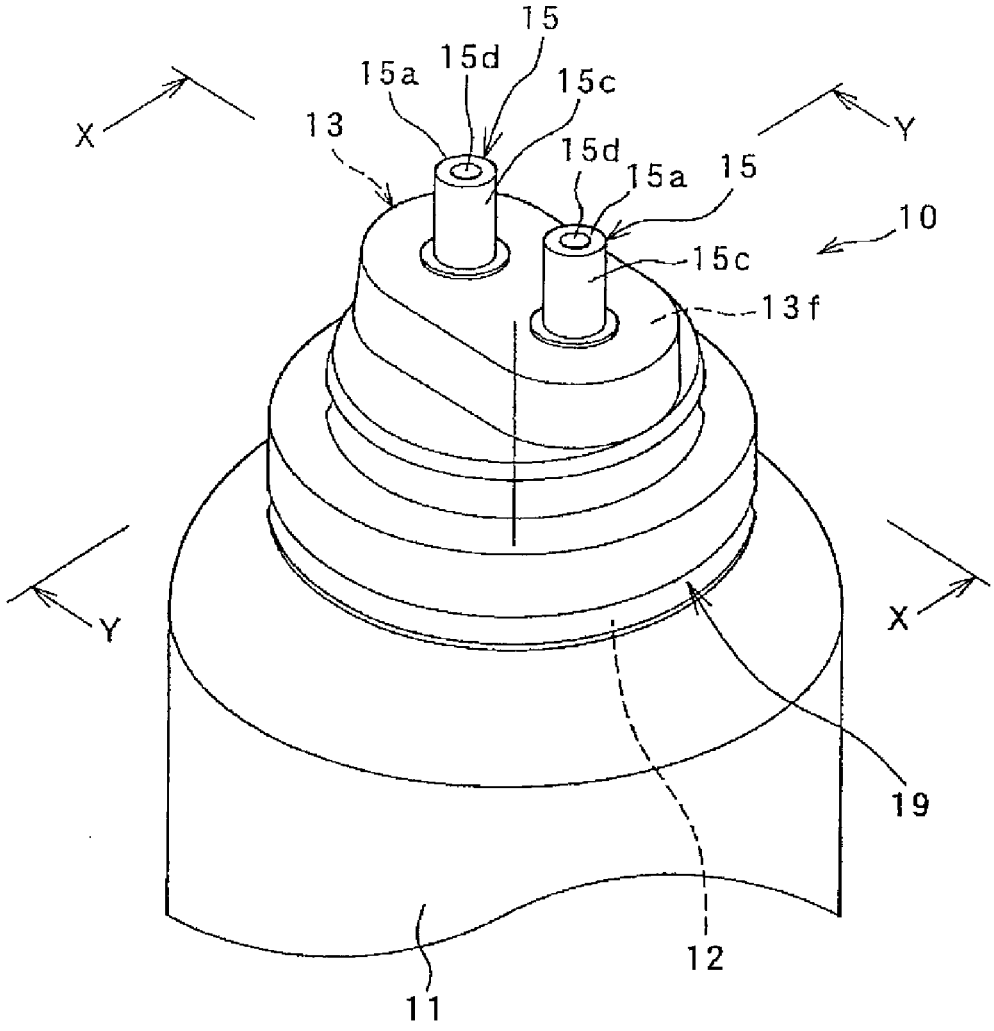
FIG. 1 is a partial outside perspective view of an embodiment of the aerosol device according to the invention.
Figure 2:
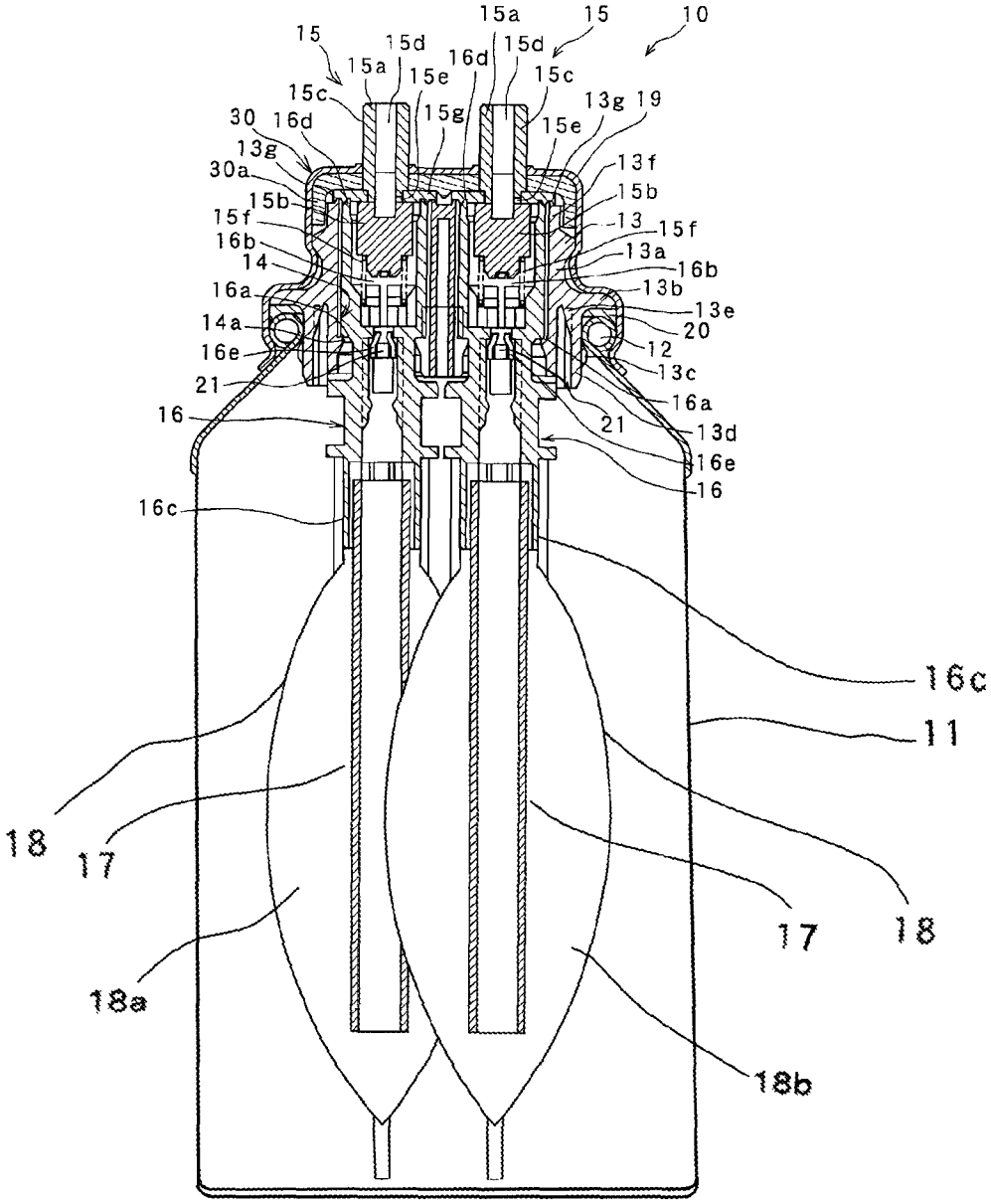
FIG. 2 is a vertical sectional view in the central portion of one embodiment of the aerosol device according to the invention (X-X section in FIG. 1).
Figure 3:
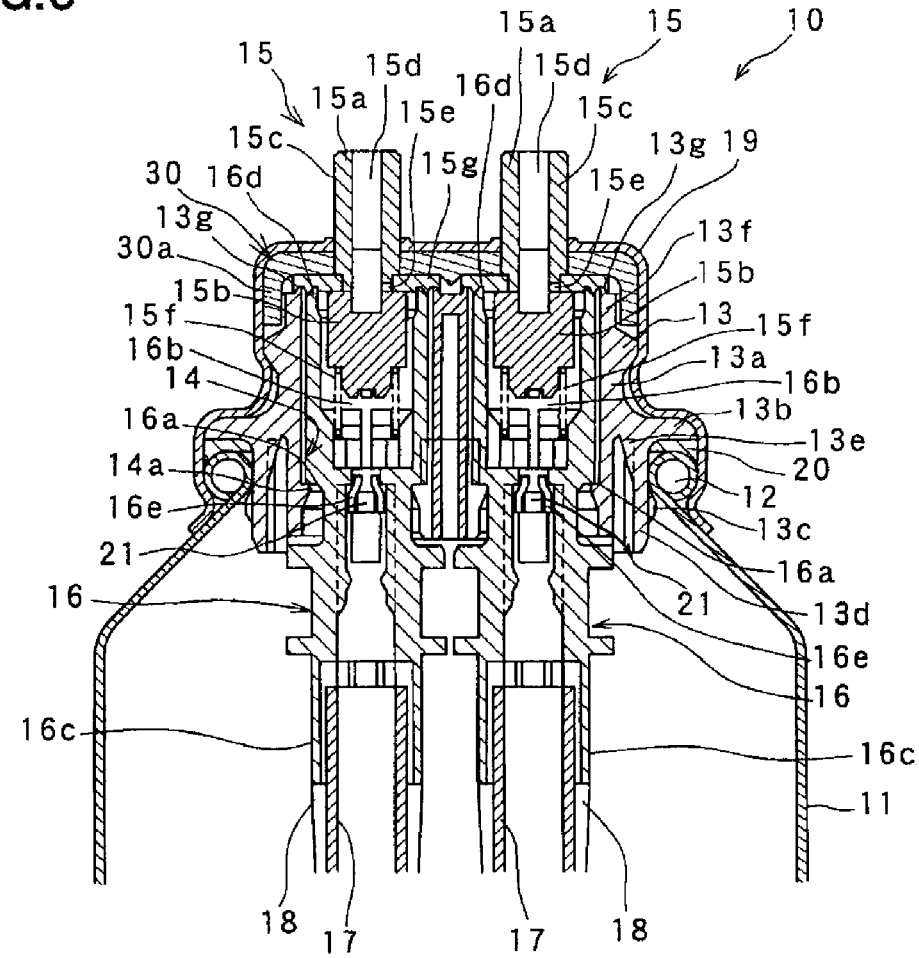
FIG. 3 is a partial vertical sectional view in the central portion of one embodiment of the aerosol device according to the invention (X-X section in FIG. 1).
Figure 4:
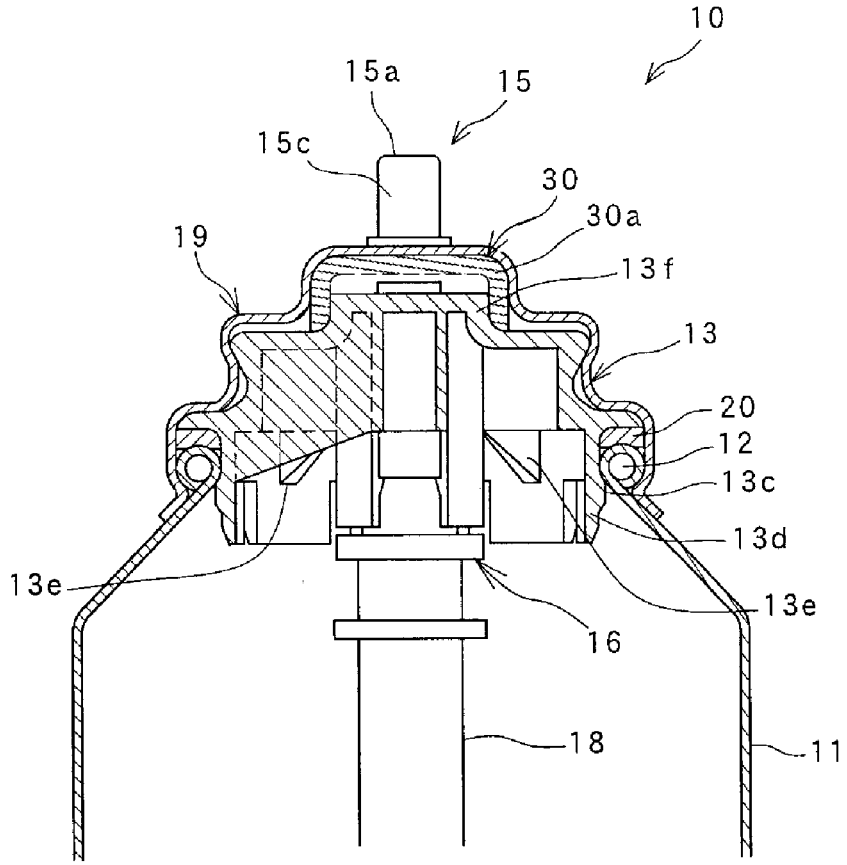
FIG. 4 is a partial vertical sectional view in the central portion of the embodiment of the aerosol device crossing FIG. 1 (Y-Y section in FIG. 1).
Figure 5B:
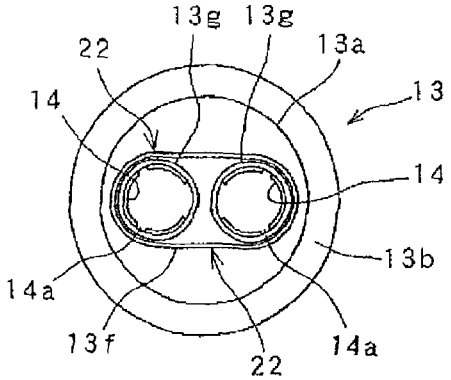
FIGS. 5A-5D are a front view, a plan view, a bottom view and a side view of a mounting member of the aerosol device according to the invention.
Figure 5A:
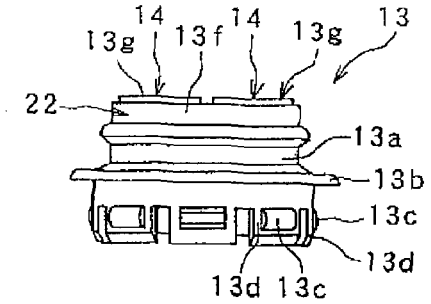
Figure 5D:
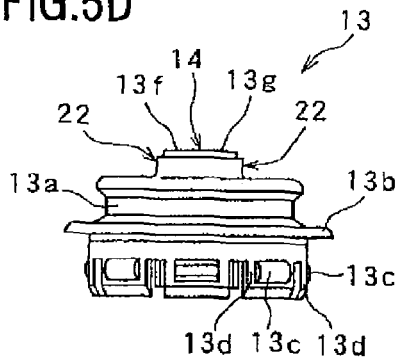
Figure 5C:
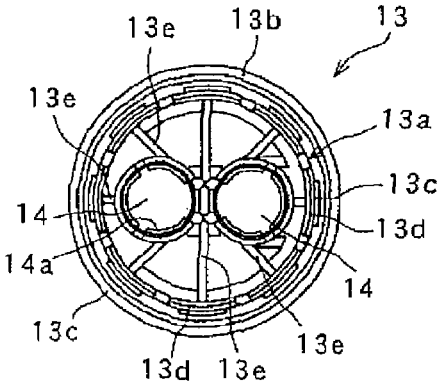
Figure 6B:
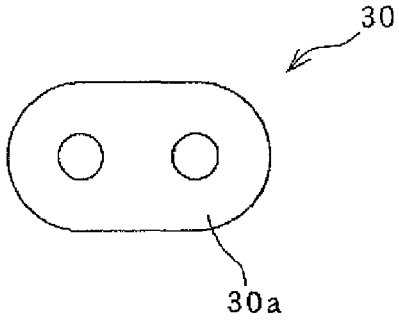
FIGS. 6A-6D are a vertical sectional view in the central portion, a plan view, a bottom view and a side view of a reinforcing cover member of the embodiment of the aerosol device.
Figure 6A:
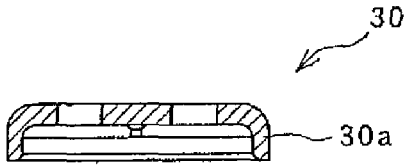
Figure 6D:
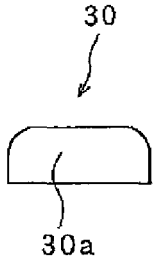
Figure 6C:
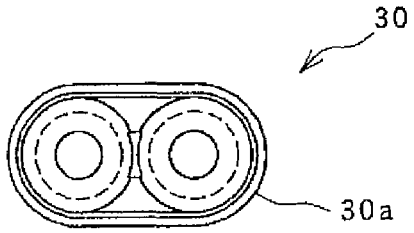
Figure 7:
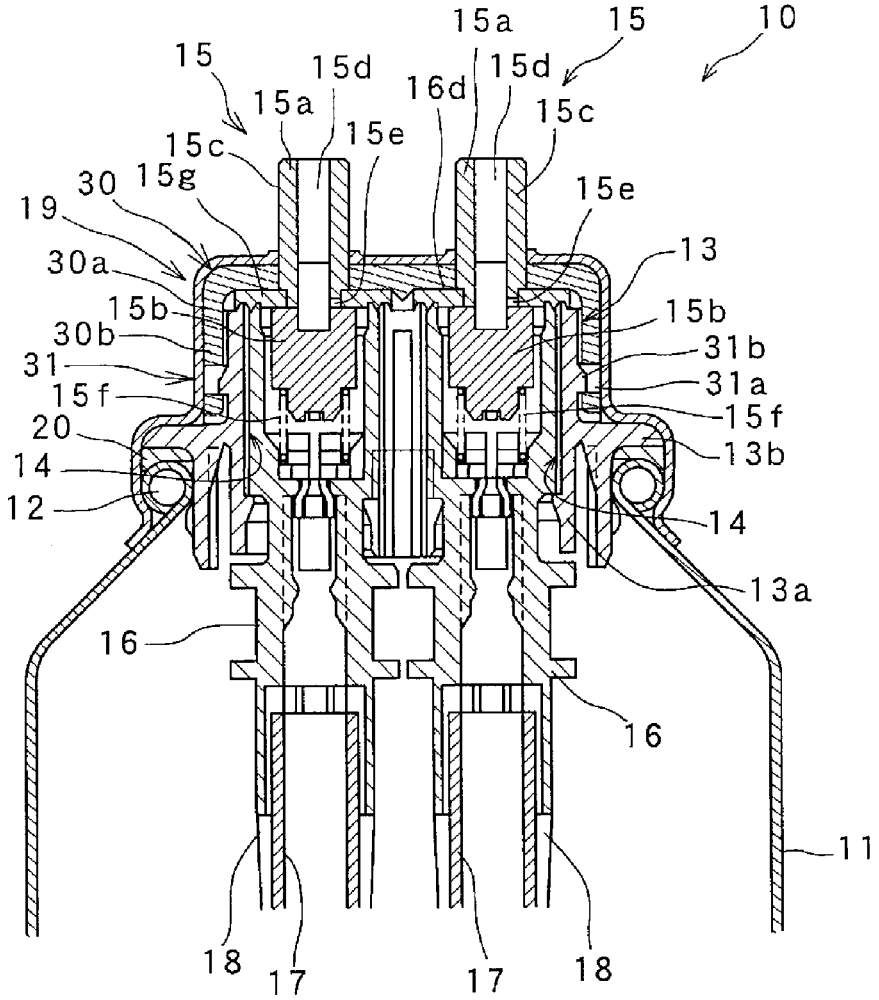
FIG. 7 is a vertical sectional view in the central portion of another embodiment of the aerosol device according to the invention corresponding to X-X section of FIG. 1.
Figure 8:
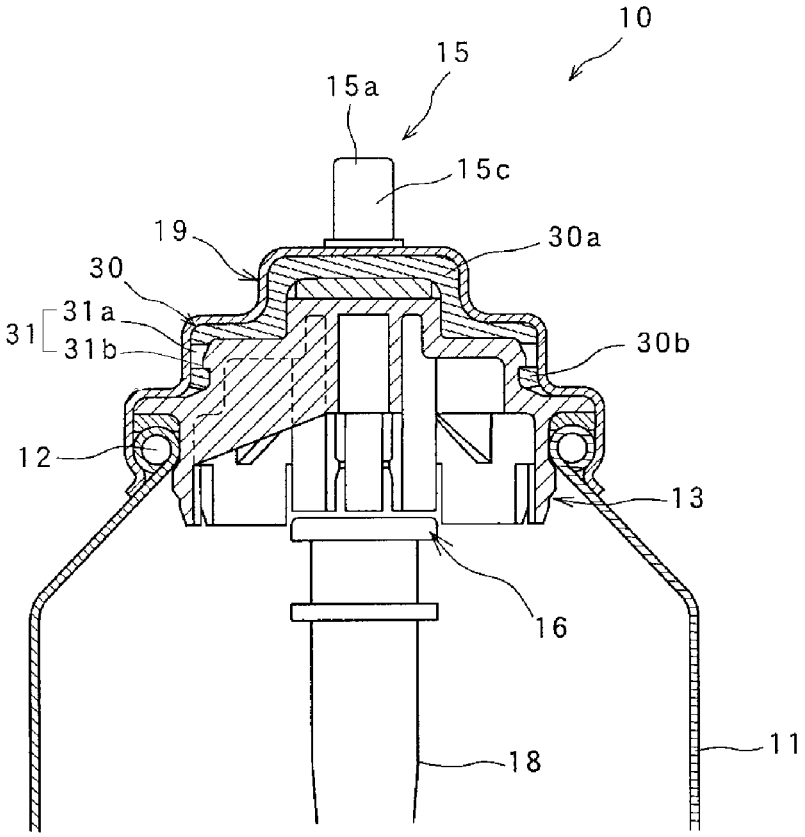
FIG. 8 is a partial vertical sectional view in the central portion of the other embodiment of the aerosol device according to the invention crossing FIG. 6 corresponding to Y-Y section of FIG. 1.
Figure 9B:
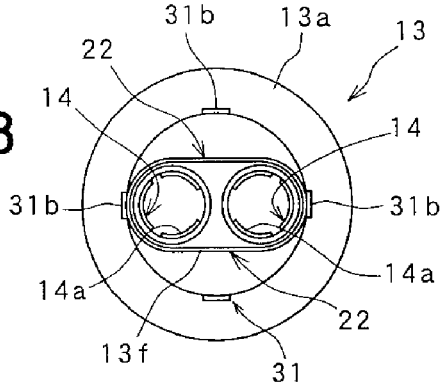
FIGS. 9A-9D are a front view, a plan view, a bottom view and a side view of a mounting member of the other embodiment of the aerosol device.
Figure 9A:
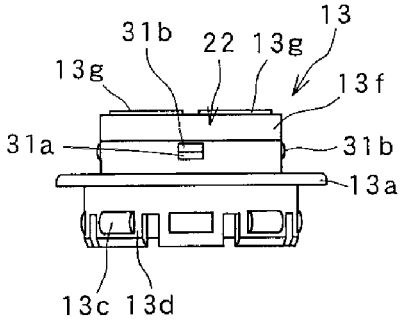
Figure 9D:
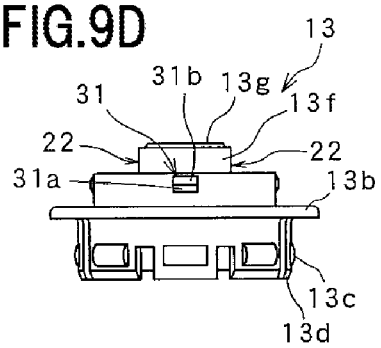
Figure 9C:
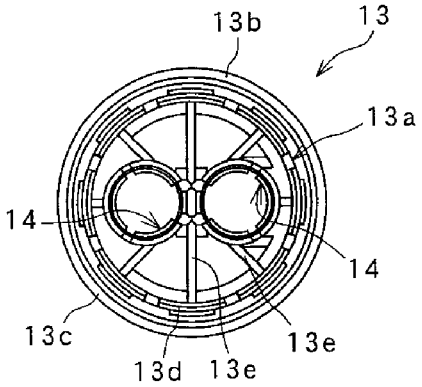
Figure 10B:
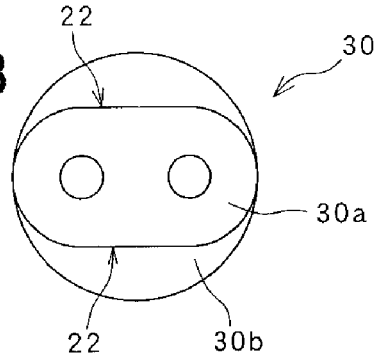
FIGS. 10A-10D are a vertical sectional view in the central portion, a plan view, a bottom view and a side view of a reinforcing cover member of the embodiment of the aerosol device.
Figure 10A:
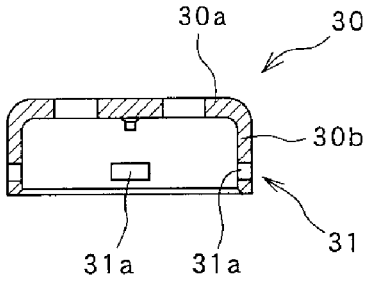
Figure 10D:
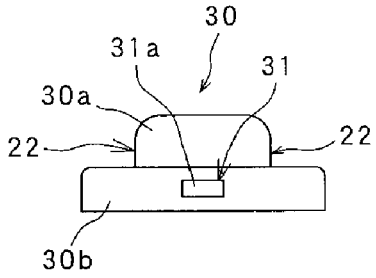
Figure 10C:
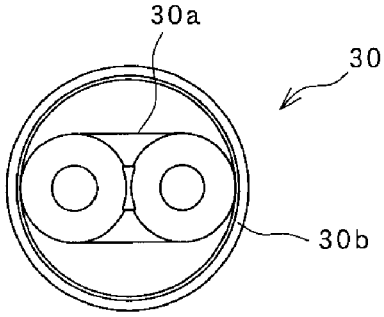
Figure 11B:
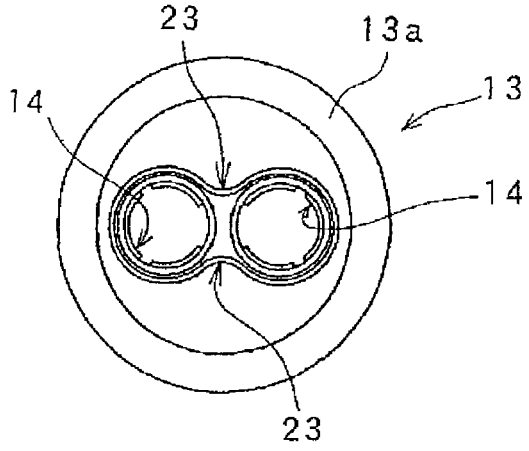
FIGS. 11A-11D are a front view and a plan view of a mounting member and a vertical sectional view in the central portion and a plan view of a reinforcing cover member of another embodiment of the aerosol device according to the invention.
Figure 11A:
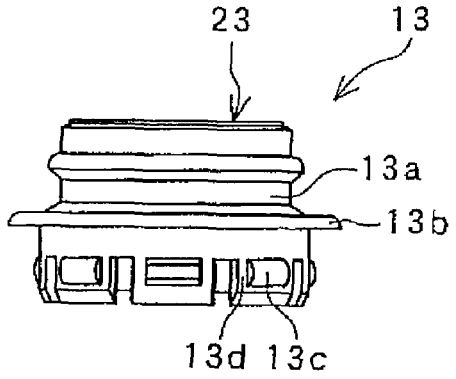
Figure 11D:
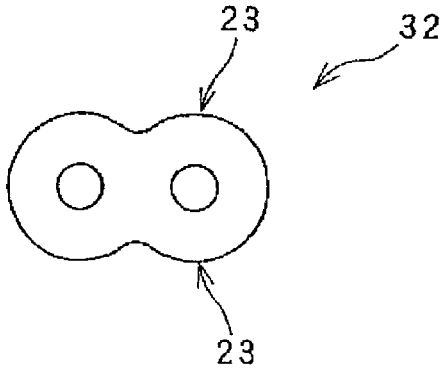
Figure 11C:
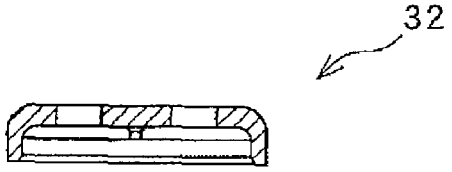
Figure 12B:
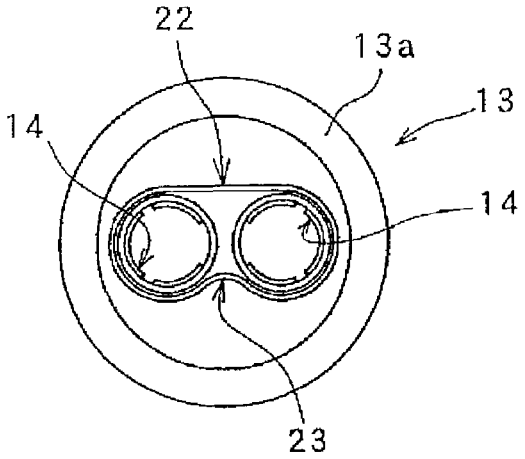
FIGS. 12A-12D are a front view and a plan view of a mounting member and a vertical sectional view in the central portion and a plan view of a reinforcing cover member of still another embodiment of the aerosol device according to the invention.
Figure 12A:
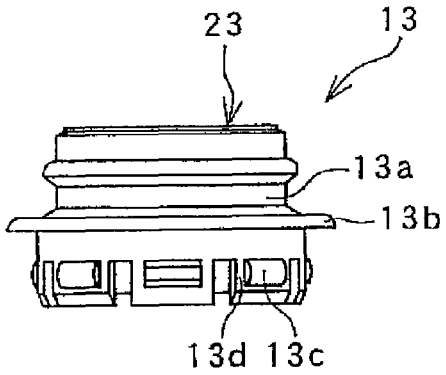
Figure 12D:
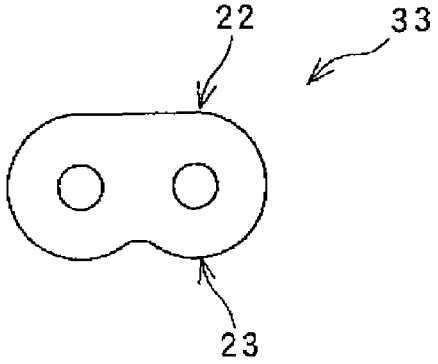
Figure 12C:
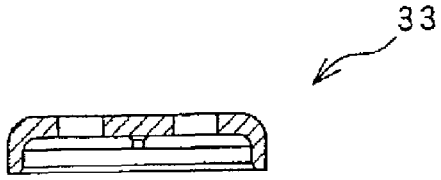

In an embodiment of an aerosol device 10 for dispensing plural kinds of liquids according to the invention, as shown in FIG. 1 and FIG. 2, a pair of aerosol valves 15, 15 are provided in an aerosol container 11 which is an inch can having an inner diameter of 1 inch and having a bead 12 which is generally used as a standard can. Inner bags 18,18 are connected to respective aerosol valves 15, 15.

In this aerosol device 10 for dispensing plural kinds of liquids, as shown in FIGS. 1-4, a mounting member 13 made of synthetic resin is fitted and mounted on the bead 12 of the aerosol container 11. A pair of valve housing mounting portions 14, 14 are formed in the mounting member 13 and the aerosol valves 15, 15 are mounted on the valve housing mounting portions 14, 14.

This mounting member 13 has, as shown in FIGS. 5(*a*)-(*d*), a mounting member main body 13*a* of a generally cylindrical shape. A flange portion 13*b* is formed in the outer periphery of the middle portion of the mounting member main body 13*b* and this flange portion 13*b* abuts against the upper portion of the bead 12. Eight engaging portions 13*d* each formed with an engaging projection 13*c* which is engaged with the inner peripheral surface of the bead 12 are provided at an equal circumferential interval below the flange portion 13*b*. The upper end portion of each of the engaging portions 13*d* is connected to the mounting member main body 13*a* with radial ribs 13*e* which extend radially and the engaging portions 13*d* can be elastically deformed in a buffer space formed between the engaging portions 13*d* and the mounting member main body 13*a* and, therefore, by pushing down the mounting member 13, the mounting member 13 can be fitted and mounted on the bead 12.

In the mounting member main body 13*a* fitted and mounted on the bead 12 of the aerosol container 11, the valve housing mounting portions 14, 14 which are parallel in vertical direction and each of which has a small cylindrical shape are provided on both sides of the central axis of mounting member 13. The valve housing mounting portions 14, 14 are supported in the mounting member main body 13*a* through the radial ribs 13*e* which support the engaging portions 13*d*. The upper end portions of the valve housing mounting portions 14, 14 are located in a top end projecting portion 13*f* of a substantially elliptic cylinder shape which projects at the top of the mounting member main body 13*a* and has a pair of parallel flat side walls 22, 22 and a pair of semicircle walls at the ends of the flat side walls.

In the inner periphery in the middle portion of the valve housing mounting portions 14, 14, there are formed engaging pawls 14*a* for engaging with the valve housing 16, 16 of the aerosol valves 15, 15.

The valve housings 16, 16 of the aerosol valves 15, 15 mounted on the pair of valve housing mounting portions 14, 14 are substantially of a cylindrical shape and formed in the outer periphery in the middle portion thereof with engaging stepped portions 16*a*. By engaging of the engaging pawls 14*a* of the valve housing mounting portions 14 with the engaging stepped portions 16*a*, the valve housings 16, 16 are engaged with and fixed to the valve housing mounting portions 14, 14.

Each of these valve housings 16 is formed in its upper portion with a valve chamber 16*b* and, in its lower portion, with a tube mounting portion 16*c*. A dip tube 17 is mounted on the tube mounting portion 16*c*. An inner bag 17 which can change its capacity by pressure applied by a propellant is also attached to the tube mounting portion 16*c*.

In each of the aerosol valves 15, 15 mounted on the valve chambers 16*b*, a stem 15*a* is formed integrally with a stem body 15*b* and a stem projecting portion 15*c*. An injection opening 15*d* is formed in the central portion of the stem projecting portion 15*c* and orifices 15*e* communicating with the valve chamber 16*b* are formed on opposite sides of the stem projecting portion 15*c* at positions adjacent to the upper surface of the stem body 15*b*. The stem 15*a* and the stem body 15*b* which is integral with the stem 15*a* are urged upwardly by a spring 15*f* provided at the bottom of the valve chamber 16*b*. Each of the stems 15*a* penetrates a central opening of an annular stem gasket 15*g* which is opened and closed as a valve. In a state in which the stem 15*a* is urged to the upper end which is an ordinary position of the stem 15*a*, the orifices 15*e* opening on the opposite sides of the stem 15*a* are closed and communication between the valve chamber 16*b* and the injection opening 15*d* thereby is interrupted. When the stem 15*a* is pushed down, the stem gasket 15*g* is bent to open the orifices 15*e* and thereby cause the valve chamber 16*b* to communicate with the injection opening 15*d* of the stem 15*a*.

The stem gasket 15*g* which is opened and closed as a valve extends over both the upper surface of the valve housing 16 and the upper surface of the top end projecting portion 13*f* of the mounting member 13. Seal points 16*d* and 13*g* in the form of annular concentric projections are formed on the upper surface of the valve housing 16 and the upper surface of the top end projecting portion 13*f* of the mounting member 13 so that, when the stem gasket 15*g* is pressed from above, surface pressure is increased and seal thereby is realized. In this embodiment, an integral stem gasket 15*g* is used in correspondence to the two stems 15*a*, 15*a* and this gasket 15*g* is formed to correspond to the shape of the upper surface of the generally elliptic cylinder shape of the top end projecting portion 13*f*.

A cover 19 made of a metallic plate such as an aluminum plate is provided in a manner to cover the mounting member 13 and the valve housings 16, 16. The two stems 15*a*, 15*a* project through the cover 19. The cover 19 holds down the stem gasket 15*g* and the lower end peripheral portion of the cover 19 is fixed to the outside of the bead 12 of the aerosol container 11.

This cover 19 has such a shape that the uppermost portion of the cover 19 covers the outside of the top end projecting portion 13*f* of the generally elliptic shape. A cylindrical portion of a small diameter, a cylindrical portion of a large diameter and a crimp portion are formed continuously below the uppermost portion. When the cover 19 is fixed to the bead 12, a seal gasket is disposed between the upper surface of the bead 12 and the flange portion 13*b* of the mounting member 13 and the cover 19 is crimped. Sealing property of the aerosol container 11 thereby is improved.

In this aerosol device 10 for dispensing plural kinds of liquids, for performing contents filling operation smoothly and adjusting an amount of flow of injected liquid, a lower valve chamber 16*e* is provided below each of the valve chambers 16*b* and a poppet valve 21 is mounted on the lower valve chamber 16*e*. When contents liquids are filled, the poppet valve 21 is brought to its lower position for forming a flow path around the poppet valve 21 and thereby enabling filling of contents liquids in a short period of time. When the aerosol device is used after filling of contents liquids, the poppet valve 21 is pushed up by contents liquids and held in its upper position for controlling the amount of flow of injection in the central flow path.

Therefore, by mounting of the poppet valves 21, it is not necessary to control the flow amount of injection at the orifices 15*e* of the stem 15*a* and a large opening which does not hamper filling of contents liquids may be formed.

In the aerosol device of this embodiment, the single stem gasket 15*g* corresponding to the two stems 15*a*, 15*a* is held down by the cover 19. Since, however, the area of the stem gasket 15*g* is increased in correspondence to the area of the top end projecting portion 13*f* as compared with a stem gasket corresponding to the prior art single stem and the area of the aerosol container 11 to which internal pressure of the aerosol container 11 is applied is also increased, a reinforcing cover member 30 made of synthetic resin is provided for holding down the stem gasket 15*g* and preventing deformation of the cover 19.

This reinforcing cover member 30 includes, as shown in FIG. 6(*a*)-(*d*), a cover main body 30*a* which covers the outside surface of the top end projecting portion 13*f* of the mounting member 13 and holds down the stem gasket 15*g* and prevents deformation of the cover 19 by rigidity of synthetic resin.

By holding the cover 19 by means of the reinforcing cover member 30, increase in the pressure receiving area can be sufficiently coped with by using a relatively simple part.

As the reinforcing cover member 30, as shown in FIGS. 7-10 which show another embodiment of the aerosol device for dispensing plural kinds of liquids according to the invention, the reinforcing cover member 30 may be constructed as a member which has, in addition to a cover main body 30*a* covering the outside surface of the top end projecting portion 13*f* of the mounting member 13, a bottom portion 30*b* which covers the mounting member main body 13*a* of the mounting member 13 which is formed continuously below the cover main body 30*a*. By forming this bottom portion 30*b*, it becomes possible to provide holding means 31 for holding the reinforcing cover member 30 to the mounting member 13. As this holding means 31, for example, four laterally elongated slits 31*a* constituting the holding means 31 may be formed in the peripheral side walls of the bottom portion 30*b* and pawls 31*b* projecting outwardly may be formed at corresponding positions of the main body of the mounting member 13.

By holding the assembled state by engaging the slits 31*a* and the pawls 31*b* of the holding means 31 provided between the reinforcing cover member 30 and the mounting member 13, the aerosol valve 15 can be held in an assembled state even before covering the outside of the aerosol valve with the cover 19 and fixing the cover 19 to the bead 12 of the aerosol container 11. Therefore, manufacturing and assembling of the aerosol device can be facilitated and filling of a propellant before fixing can also be facilitated.

The structure of the aerosol device in other respects is the same as the structure of the previously described embodiment.

In a case where the cover 19 can prevent deforming by virtue of its material, thickness of plate or the like reason, the reinforcing cover member 30 may be omitted and the number of the component parts thereby can be reduced.

In the above described embodiments, the flange portion 13*b* is formed in the mounting member 13 and this flange portion 13*b* abuts against the bead 12 of the aerosol container 11. Alternatively, the flange portion may be omitted and the middle portion of the mounting member 13 may be positioned at the bead 12 in such a manner that a part of the mounting member 13 projects upwardly to cover a part of the cover 19 and is fixed to the bead 12. By this arrangement, the shape of the mounting member 13 will be simplified and production of a mold will become easy.

In the aerosol container 11, as shown in FIG. 2, the inner bags 18, 18 are connected to the aerosol valves 15, 15 so that the contents liquids are injected simultaneously from the two inner bags 18, 18 by means of a propellant filled in the aerosol container 11.

In a case where a hair dye for example is filled as contents liquid in this aerosol device 10, the first agent and the second agent of the hair dye are filled in the inner bags 18, 18 and the first agent and the second agent can be injected in separated state without mixing together and these two agents can be simultaneously mixed at predetermined ratio of amounts by one touch finger operation of the user.

As the inner bags 18, 18 for the first agent and the second agent of the hair dye, pouches 18*a*, 18*b* for example may be used. In the first pouch 18*a* in which the first agent is filled and the second pouch 18*b* in which the second agent is filled, the first agent which consists of a dye and a strong alkali component using ammonia as a main ingredient is filled in the first pouch 18*a* whereas the second agent which consists of an acidic component having oxidative property using hydrogen peroxide as a main ingredient is filled in the second pouch 18*b*.

In case the two agents of the hair dye are housed in a single aerosol container 11, if the component of the first agent which consists of a strong alkali component contacts oxygen during storing of the first agent, chemical degradation will take place with resulting deterioration in a hair dying function and, if such contact of the component with oxygen continues, the hair dying function will ultimately be lost. It will therefore be necessary to prevent oxygen from the second agent from entering the first agent.

For this reason, as to materials for forming the pouches 18*a*, 18*b* mounted in the aerosol container 11, each of the pouches 18*a*, 18*b* is made of laminated materials of a metal foil having an oxygen shielding property and an inner layer of a thermoplastic resin, or is made of a thermoplastic resin. At least one of the two pouches is made of laminated materials of a metal foil and an inner layer of a thermoplastic resin.

As a metal foil, an aluminum foil or an iron foil may be used. From the standpoints of processing property, anticorrosion property and economic advantage, the aluminum foil is most proper. Thickness of the metal foil is set to about 5-100 μm. An outer protective layer of a thermoplastic resin should preferably be laminated on the outer surface of the metal foil. A coating film such as epoxy may also be provided on the surface of the metal foil.

If a plastic material having a high oxygen shielding property is used, a metal deposited plastic film which does not employ a metal foil, for example, may be used.

As a pouch using a metal foil, laminated materials made of a metal foil and an inner layer of thermoplastic resin may be used and, in this case, the laminated materials should preferably be made of a metal foil layer, an acid-denatured adhering thermoplastic resin layer and a thermoplastic resin layer having a heat sealing property. The metal foil should preferably be made of an aluminum foil, the thermoplastic resin layer having a heat sealing property should preferably be made of a polyolefin resin, and the acid-denatured adhering thermoplastic resin layer should preferably be made of a maleic anhydride denatured-polyolefin resin.

A specific example of the pouch is made of an outer layer material (PET single layer or a nylon single layer or two layers of PET and nylon)/an aluminum foil/adhering denaturated polyolefin/polypropylene inner layer.

For preventing delamination due to the strong alkali component in the acidic hair dye, a special adherent layer is necessary. For coping with this problem, as a specific adhesive, an acid-denatured thermoplastic resin adhesive, particularly a maleic anhydride graft polyethylene resin, may be used for effectively and completely prevent delamination during storing before use of the hair dye. By this arrangement, delamination or corrosion of an aluminum foil does not occur during usually required storing period of six months at 40° C., showing excellent contents quality.

As the acid-denatured thermoplastic resin adhesive, thermoplastic resin having carboxyl group based on free carboxylic acid, carboxylic acid ester, carboxylic acid amide or carboxylic acid anhydride, or a composition (blend) of this resin and other thermoplastic resin may be used. Particularly, thermoplastic resins such as a polyolefin which is chemically denatured by carboxylic acid such as maleic acid or acrylic acid, and a polyolefin obtained by grafting an unsaturated monomer of ethylene having an atom group based on carboxylic acid anhydride such as maleic acid anhydride and itaconic acid anhydride may be preferably used. Particularly, from the standpoint of adhesive function, polyolefin obtained by grafting maleic acid anhydride (low-density polyethylene (LDPE)) may be preferably used.

In the pouch 18*b* for the second agent consisting of an acidic component comprising hydrogen peroxide, delamination due to agents contained is not so strong as in the first agent and, therefore, dry lamination using a polyethylene terephthalate resin '(PET) may be used. The second pouch may also be formed with laminated materials of an aluminum foil and a PET layer laminated with a polyurethane adhesive.

In the pouch 18*a* for the first agent also, laminated materials laminated by using a polyurethane adhesive may be used.

Instead of the laminated materials consisting of a metal foil and a thermoplastic resin inner layer, the pouch may also be formed by using laminated materials having a first layer consisting of an amorphous or low crystalline copolymer (so-called COC) of an olefin and a cyclic olefin and a second layer consisting of an oxygen shielding thermoplastic resin.

COC is known as a normal material for forming a layer of a container. As olefin for copolymerizing COC which is an amorphous or low-crystalline copolymer of an olefin and a cyclic olefin, ethylene is suitable. As other suitable olefins, α-olefins having a carbon number of 3-20 such as propylene, 1-butene, 1-pentene, 1-hexene, 1-octene, 3-methyl-1-pentene and 1-decene may be used singly or in combination with ethylene. As cyclic olefins, alicyclic hydrocarbon compounds having an ethylene unsaturated bond and a bicycle ring such as alicyclic hydrocarbon compounds having a bicyclo [2,2,1]hepto-2-ene skeleton may be basically used. A tricyclo [4,3,0,$1^{2,5}$]-3-decene and tetracyclo derivatives and other derivatives and these compounds having a substituent may also be used.

As the COC, a COC consisting of 10-50% of cyclic olefin and other olefin and having a glass transition point of 5-200° C. is preferable from the standpoint of formability, adherence and water shielding property.

As materials of the pouches which are mounted in the container, laminated materials consisting of a metal foil and a thermoplastic resin inner layer for example are laminated together by means of a polyolefin thermoplastic adhering resin. For laminating these materials, an extrusion coat laminating method may be used according to which polyolefin thermoplastic adherent resin is extruded and laminated onto a metal foil. A powder coat laminating method may also be used according to which polyolefin thermoplastic adhering resin powder is deposited on a metal foil and the powder is heated and fused by, e.g., high frequency heating and a thermoplastic resin inner layer thereby is laminated.

Description will now be made about results of a test conducted on specific examples of the pouches 18*a*, 18*b* as the inner bags 18, 18 used for the aerosol device 10 for dispensing plural kinds of liquids with respect to a case where a hair dye is filled in the pouches. The examples of the test however will not limit the scope of the present invention in any way.

[Conditions of the Test]

In the test, two types of pouch in which three layers are laminated and two types of pouch in which four layers are laminated, totaling four types of pouch, were used. Each of these pouches had a spout. Aerosol containers were prepared and in each of these containers, the first agent of a strong alkali component and the second agent of an acidic component having oxidative property of a hair dye were filled in the amount of 50 g or 60 g. An enhancing test of storing three months at 45° C. was conducted with respect of these aerosol containers.

As a propellant, nitrogen gas (equilibrium pressure: adjusted to 0.48 MPa) was used.

[Items Measured]

As characteristics of products, pressure of the product, state of injection, pH measurement and weight measurement were conducted on 20 pouches.

For estimating appearance, presence or absence of delamination, pin holes, withdrawal of the seal and black spots were observed by eye with respect to 5 pouches of the respective types of pouches.

Test Example 1

A pouch having a three-layer laminate was used. The laminated layers were, from outside, a PET layer having thickness of 12 μm, a aluminum foil having thickness of 9 μm, and a PP (polypropylene) layer having thickness of 60 μm. A spout made of the same PP as used for the inner layer was formed.

As a result of the test, no abnormality was measured in the product pressure, state of injection, pH measurement and weight measurement. However, in the appearance, as shown in Table 1, no abnormality was observed in the pouches for the first agent but occurrence of blister was observed in one pouch among five pouches in which the second agent was filled.

Test Example 2

A pouch having a three-layer laminate was used. The laminated layers were, from outside, a PET layer having thickness of 12 μm, a aluminum foil having thickness of 9 μm, and a PE (polyethylene) layer having thickness of 60 μm. A spout made of the same PE as used for the inner layer was formed.

As a result of the test, no abnormality was measured in the product pressure, state of injection, pH measurement and weight measurement. However, in the appearance, as shown in Table 1, no abnormality was observed in the pouches for the first agent but occurrence of blister was observed in all of the five pouches in which the second agent was filled.

Test Example 3

A pouch having a four-layer laminate was used. The laminated layers were, from outside, a PET layer having thickness of 12 μm, a aluminum foil having thickness of 9 μm, a PET layer having thickness of 12 μm, and a PP (polypropylene) layer having thickness of 60 μm. A spout made of the same PP as used for the inner layer was formed.

As a result of the test, no abnormality was measured in the product pressure, state of injection, pH measurement and weight measurement. However, in the appearance, as shown in Table 1, no abnormality was observed in the pouches for the second agent but occurrence of breakage in the spout portion was observed in one pouch among five pouches in which the first agent was filled.

Test Example 4

A pouch having a four-layer laminate was used. The laminated layers were, from outside, a PET layer having thickness of 12 μm, a aluminum foil having thickness of 9 μm, a PET layer having thickness of 12 μm, and a PE (polyethylene) layer having thickness of 60 μm. A spout made of the same PE as used for the inner layer was formed.

As a result of the test, no abnormality was measured in the product pressure, state of injection, pH measurement and weight measurement. However, in the appearance, as shown in Table 1, no abnormality was observed in the pouches for the second agent but occurrence of breakage in the spout portion was observed in one pouch among five pouches in which the first agent was filled.

[Estimate of the Test Examples]

From the results of the above tests, it was found that as to the first agent having a strong alkali component of the hair dye, the pouches of Test Examples 1 and 2, that is, the pouch having the three layers in which the laminated layers were, from outside, a PET layer having thickness of 12 μm, a aluminum foil having thickness of 9 μm, a PET layer having thickness of 12 μm, and a PP (polypropylene) layer having thickness of 60 μm and having a spout made of the same PP as used for the inner layer, or the pouch having the three layers in which the laminated layers were, from outside, a PET layer having thickness of 12 μm, a aluminum foil having thickness of 9 μm, and a PE (polyethylene) layer having thickness of 60 μm and having a spout made of the same PE as used for the inner layer, can be used without occurrence of any abnormality in the product characteristics and the estimate of appearance.

On the other hand, it was found, as to the second agent having an acidic component having an oxidative property of the hair dye, the pouches of Test Examples 3 and 4, that is, the pouch having the four layers, in which the laminated layers were, from outside, a PET layer having thickness of 12 μm, a aluminum foil having thickness of 9 μm, a PET layer having thickness of 12 μm, and a PP (polypropylene) layer having thickness of 60 μm and having a spout made of the same PP, or the pouch having the four layers, in which the laminated layers were, from outside, a PET layer having thickness of 12 μm, a aluminum foil having thickness of 9 μm, a PET layer having thickness of 12 μm, and a PE (polyethylene) layer having thickness of 60 μm and having a spout made of the same PE can be used without occurrence of any abnormality in the product characteristics and the estimate of appearance.

By preparing pouches as inner bags having such different structure of layers and mounting these pouches in the aerosol container 11, the first agent and the second agent of the hair dye can be filled and stored in a single aerosol container without any trouble. By this arrangement, the first agent and the second agent can be injected simultaneously and mixed together at a predetermined amount ratio and aerosol products can be produced easily and inexpensively.

TABLE 1

| Pouch specification | | | Test on pouches 60 g | Test on pouches 50 g |
|---|---|---|---|---|
| ① | 12PET/9AL/60PP | First agent | ○ | ○ |
| | | Second agent | ⊗ (1/5) | ⊗ (1/5) |
| ② | 12PET/9AL/60PE | First agent | ○ | ○ |
| | | Second agent | ⊗ (5/5) | ⊗ (5/5) |
| ③ | 12PET/9AL/12PET/60PP | First agent | X[1)] (1/5) | X[1)] (1/5) |
| | | Second agent | ○ | ○ |
| ④ | 12PET/9AL/12PET/60PE | First agent | X[1)] (1/5) | X[1)] (1/5) |
| | | Second agent | ○ | ○ |

○: no abnormality
⊗: blister occurred
X[1)]: breakage in spout

Description will now be made about a process of assembling of the aerosol device 10 for dispensing plural kinds of liquids and about filling of contents liquid and a propellant.

In the mounting member 13, the seal gasket 20 for sealing with the bead 12 is attached on the lower surface of the flange portion 13*b* of the mounting member main body 13*a*.

In the valve housing 16, the poppet valve 21 is mounted in the lower valve chamber 16*e* with a gap being formed around the poppet valve 21 and then the dip tube 17 is connected to the tube mounting portion 16*c* at the lower end of the valve housing 16 and the pouches 18*a*, 18*b* as the inner bags 18, 18 are mounted in a manner to cover the dip tube 17 and fixed to the outside surface of the dip tube mounting portion 16*c*. This arrangement prevents an accident that the pouches 18*a*, 18*b* are collapsed in the middle portion with the result that remaining contents liquid cannot come out.

Then, the valve housing 16 to which the dip tube 17 and the pouches 18*a*, 18*b* as the inner bags 18, 18 are fixed is mounted on the valve housing mounting portion 14 of the mounting member 13 from the lower portion of the valve housing 16 and is fixed at a predetermined position by engaging the engaging stepped portion 16*a* with the engaging pawl 14*a*.

In the aerosol valve 15, the stem 15*a* and the spring 15*f* are assembled and then the stem gasket 15*g* is mounted on the aerosol valve 15 with the stem 15*a* projecting through the stem gasket 15*g*.

Then, the aerosol valve 15 assembled in the above described manner is mounted on the valve chamber 16*b* of the valve housing 16 in such a manner that the stem gasket 15*g* is positioned on the upper surface of the mounting member 13 and the valve housing 16.

In the above described manner, a pair of the aerosol valves 15, 15 are mounted on the mounting member 13 via the valve housings 16, 16 with the stem gasket 15*g* disposed in position. Then, the reinforcing cover member 30 is provided in a manner to hold down the stem gasket 15*g*. Further, the outside surface of the reinforcing cover member 30 is covered with the cover 19 and the mounting member 13 and the cover 19 are fixed whereby the stem gasket 15*g* is pressed by the mounting member 13 and the seal points 13*g*, 16*d* of the valve housing 16 and the aerosol valves 15, 15 are brought to a closed state.

In the state in which the mounting member 13 and the valve housing 16 are covered with the cover 19, the pouches 18*a*, 18*b* as the inner bags 18, 18 are inserted into the open head portion of the aerosol container 11 and the seal gasket 20 is disposed on the bead 12 under the lower surface of the flange portion 13*b*.

In this state, the engaging projections 13*c* of the engaging portions 13*d* of the mounting member 13 mounted from the open head portion are not in an engaged state and a gap is formed between the bead 12 of the aerosol container 11 and the mounting member 13. Therefore, the aerosol container 11 is in communication with the outside.

In this state, a propellant is injected into the aerosol container 11.

Filling of the propellant is performed, in the same manner as in the prior art device, by disposing a propellant filling head around the cover 19, filling the propellant such as nitrogen gas into the aerosol container 11 through the gap between the bead 12 of the aerosol container 11 and the mounting member 13, pushing down the mounting member 13 upon completion of filling to bring the engaging projections 13*c* of the projecting portions 13*d* into engaged state and, after the mounting member 13 is fitted and mounted, crimping the crimp portion at the lower outer periphery of the cover 19 to the outer periphery of the bead 12.

In the state in which the cover 19 is crimped, the seal gasket 20 at the lower surface of the flange portion 13*b* of the mounting member 13 is pressed onto the upper surface of the bead 12 to close the aerosol container 11 whereby filing of the propellant and assembly of the component parts of the aerosol device 10 are completed.

Then, the first agent and the second agent of the hair dye as contents liquids of different kinds are separately filled into the pouches 18*a*, 18*b* as the inner bags 18, 18 through the stems 15*a*, 15*a*.

Since in the aerosol container 11 which is different from the prior art aerosol container, the two stems 15*a*, 15*a* are provided on opposite sides of the central axis and different contents liquids are filled in these stems, it is necessary in the filling process to position the aerosol container 11 and contents liquids must be filled in the predetermined stems 15*a*, 15*a*. Since the top end projecting portion 13*f* of the mounting member 13 has a substantially elliptical shape having parallel flat side walls 22, 22, positioning of the stems 15*a*, 15*a* in forward and rearward directions and left and right directions can be made easily by utilizing the parallel flat side wall 22, 22 and, by conducting filling in the stems 15*a*, 15*a* by maintaining this position and identifying the stems by e.g., coloring, different contents liquids can be filled in the respective pouches 18*a*, 18*b* as the inner bags 18, 18 separately.

By forming the top end projecting portion 13*f* of the mounting member 13 in the shape of the substantially elliptical shape having parallel fat side walls 22, 22 and utilizing these parallel flat side walls 22, 22 in positioning the aerosol container 11 in the filling process, the two stems 15*a*, 15*a* are positioned in forward and rearward direction and left and right directions. Alternatively, as shown in FIG. 11(*a*), the top end projecting portion 13*f* of the mounting member 13 may be formed in the shape of the FIG. 8 as viewed in a plan view with parallel curved side walls 23, 23 having a recess in the central portion on both sides. By utilizing these curved side walls 23, 23, in the same manner as in the case of the parallel flat side walls 22, 22, the two stems 13*a*, 13*a* can be positioned easily in forward and rearward directions and right and left directions. By conducting filling in the stems 15*a*, 15*a* while maintaining this state, different contents liquids can be filled in the pouches 18*a*, 18*b* as the inner bags 18, 18 separately and the stems can be held accurately by utilizing the central curved recesses.

In a case where this mounting member 13 is used, the reinforcing cover member 30 having a corresponding shape shown in FIG. 11(*d*) should be used.

In a case where positioning of the aerosol container 11 by utilizing the parallel flat side walls 22, 22 or the curved side walls 23, 23 on both sides, the two stems 15*a*, 15*a* can be positioned in forward and rearward directions and right and left direction but, in this case, positioning of the stems 15*a*, 15*a* upon discriminating these stems 15*a*, 15*a* from each other is not physically possible. In a case where, as shown in FIG. 12(*a*). the top end projecting portion 13*f* of the mounting member 13 is formed in the shape having a flat side wall 22 on one side and having a curved side wall 23 on the other side, by utilizing these flat side wall 22 and the curved side wall 23, the two stems 15*a*, 15*a* can be positioned not only in forward and rearward directions and right and left directions but also upon discriminating one stem 15*a* from the other stem 15*a*. By conducting filling in the predetermined stems 15*a*, 15*a* while maintaining this state, different contents liquids can be accurately filled in the inner bags 18 separately and the stems can be held accurately by utilizing the central recess of the curved wall 23.

In a case where this mounting member 13 is used, the reinforcing cover member 30 having a corresponding shape shown in FIG. 11(*d*) should be used.

According to the aerosol device 10 for dispensing plural kinds of liquids, two aerosol valves 15, 15 can be provided even in an inch can with a bead having an inner diameter of 1 inch and, by this arrangement, the first agent and the second agent of the hair dye as contents liquids can be dispensed and injected from the stems 15*a*, 15*a* of the respective aerosol valves 15, 15 into the pouches 18*a*, 18*b* as the inner bags and thereby to the outside in a separate state without mixing.

Thus, the aerosol device which can dispense and inject two different contents liquids of the hair dye outside can be composed of a one inch can and, therefore, the aerosol device can be manufactured at a reduced cost. It also becomes possible to inject each contents liquid with a uniform amount of injection or a predetermined amount ratio from the two aerosol valves.

According to the aerosol device 10 for dispensing plural kinds of liquids, the propellant is filled in the aerosol container 11 and the pouches 18*a*, 18*b* as the inner bags 18, 18 which can vary capacity of contents liquid filled therein are connected to the pair of aerosol valves 15, 15. By this arrangement, two kinds of contents liquids can be dispensed and injected in the state in which contents liquids are separated from the pouches 18*a* and 18*b* as the inner bags 18, 18 and therefore contents liquids can be respectively injected without contacting the interior surface of the aerosol container 11.

Further, by constituting the inner bags 18, 18 with the pouches 18*a*, 18*b*, an aerosol product in which the first and second agents of the hair dye are filled can be produced.

According to the aerosol device 10 for dispensing plural kinds of liquids. the middle portion of the mounting member 13 is located the bead 12 of the aerosol container 11 and the inserted portion of the stem 15*a* is located above the bead 12. By this arrangement, even if the two stems 15*a*, 15*a* of the two aerosol valves 15, 15 are disposed side by side, they can be fixed to the outside of the bead 12 by the cover 19 which covers the outside of the mounting member 13. Accordingly, it is not necessary to secure space for clinching in the inside as in the case of a prior art mounting cup and, therefore, two aerosol valves 15, 15 and the pouches 18*a*, 18*b* as the inner bags 18, 18 can be mounted on the aerosol container 11 without being restricted by the size of the bead 12 of a 1-inch can.

By disposing two aerosol valves 15, 15 in an inch can having 1-inch bead 12, the stem gasket 15*g* becomes of a size corresponding to the two stems 15*a*, 15*a* and the area of the top ceiling portion of the cover 19 which holds down the stem gasket 15*g* increases with the result that deformation tends to take place due to increase in the area receiving pressure by the propellant. Since, however, the reinforcing cover member 30 made of a synthetic resin is provided between the stem gasket 15*g* and the cover 19, the cover 19 can hold down the stem gasket 15*g* without likelihood of deformation.

By this arrangement, leakage due to deformation of the stem gasket 15*g* can be completely prevented.

According to the aerosol device 10 for dispensing plural kinds of liquids, the holding means 31 for holding the reinforcing cover member 30 to the mounting member 13 is provided between the reinforcing cover member 30 and the mounting member 13 and, for this purpose, the slits 31*a* are formed in the bottom portion 30*b* of the reinforcing cover member 30 and the pawls 31*b* are formed in the mounting member main body 13*a* of the mounting member 13, Accordingly, the reinforcing cover member 30 can be held to the mounting member 13 in an assembled state.

By this arrangement, the cover can cover the aerosol container 11 and can be fixed to the container 11 with the aerosol valves 15, 15 and the inner bags 18, 18 in an assembled state and, therefore, it is not necessary to assemble the device while holding down the stems 15*a*, 15*a* which are energized by the springs 15*f*, 15*f* and manufacturing and assembling works thereby can be facilitated.

According to the aerosol device 10 for dispensing plural kinds of liquids, a pair of the aerosol valves 15, 15 are provided, the top end projecting portion 13*f* of a substantially elliptical shape having parallel flat side walls 22, 22 is formed and the reinforcing cover member 30 covering this top end projecting portion 13*f* is fixed by crimping. Accordingly, positioning is facilitated by conducting assembly on the basis of the parallel flat side wall 22, 22 of the top end projecting portion 13*f* and the assembly of the device thereby can be performed efficiently and the filling process for filling contents liquids in the aerosol container 11 can also be made efficiently with respect to each of the stems 15*a*, 15*a*. In the case of adopting the shape of the top end projecting portion 13*f* having the combination of the flat side wall 22 and the curved side wall 23, not only positioning of the two stems 15*a*, 15*a* but also discrimination of the two stems can be made by coloring the two stems 15*a*, 15*a*.

According to the aerosol device 10 for dispensing plural liquids, the reinforcing cover member 30 has, in addition to the cover main body 30*a* covering the top end projecting portion 13*f*, the bottom portion 30*b* which covers the bottom portion of the mounting member 13. By covering the entire mounting member 13 including the bottom portion in addition to the top end projecting portion of the mounting member 13, the top ceiling portion of the cover 19 can be reinforced further accurately whereby deformation due to internal pressure and leakage of contents liquids can be prevented further accurately.

In the aerosol device 10 for dispensing plural kinds of liquids, contents liquids are injected by attaching an actuator such as a push-button type actuator to the two stems. Two different contents liquids may be injected in a state separated from an actuator or, alternatively, may be injected after being mixed in an actuator. Such manner of injection may be selected depending upon the type of contents liquids and purpose of use of the contents liquids.

As contents liquids filled in the two inner bags of the aerosol device for dispensing plural kinds of liquids can be cited, not only a hair dye but also, for example, a main preparation and an additive of an aerosol product which are not suitable for pre-mixing for the reason that such pre-mixed product causes a chemical reaction such as hardening or oxidation. The aerosol device is suitable, for example, for hot shaving creams, adherents, coatings and pharmaceuticals. The aerosol device is also applicable to contents liquids of foam preparations.

Description has been made about a case where a pouch is used as an inner bag. The inner bag is not limited to a pouch but may be a formed body made of a synthetic resin. The invention is not limited to a case where different inner bags are used depending upon contents liquids but is applicable also to a case where inner bags or pouches of the same specification are used.

The aerosol device for dispensing plural kinds of liquids is applicable not only to a case where two different contents liquids are dispensed and injected but also to a case where three or more kinds of contents liquids are dispensed and injected.

DESCRIPTION OF NUMERALS

10 aerosol device for dispensing plural kinds of contents liquids
11 aerosol container (inch can)
12 bead
13 mounting member
13*a* mounting member main body
13*b* flange portion
13*c* engaging projection
13*d* engaging portion
13*e* radial rib
13*f* top end projecting portion
13*g* seal point
14 valve housing mounting portion
14*a* engaging pawl
15 aerosol valve
15*a* stem
15*b* stem body
15*c* stem projecting portion
15*d* injection opening
15*e* orifice
15*f* spring
15*g* stem gasket
16 valve housing
16*a* engaging stepped portion
16*b* valve chamber
16*c* tube mounting portion
16*d* seal point
16*e* lower valve chamber
17 dip tube
18 inner bag
18*a*, 18*b* pouches
19 cover
20 seal gasket
21 poppet valve
22 flat side wall
23 curved side wall (discriminating means)
30 reinforcing cover member
30*a* cover main body
30*b* bottom portion
31 holding means
31*a* slit
31*b* pawl
32 reinforcing cover member
33 reinforcing cover member

The invention claimed is:

1. An aerosol device for dispensing plural kinds of liquids comprising:

an aerosol container having an open head portion having an inner diameter of 1 inch and formed with a bead around the open head portion;

a plurality of aerosol valves housed in the aerosol container each having a stem through which liquid contents of each of the aerosol valves is injected outside;

a mounting member which is fittedly mounted on the open head portion with a middle portion of the mounting member being located at the bead of the open head portion;

a plurality of valve housing mounting portions provided in the mounting member capable of mounting the aerosol valves, wherein each of the plurality of aerosol valves is mounted on a respective one of the plurality of valve housing mounting portions; and a cover covering the outside of the mounting member, holding a stem gasket and being fixed on the outside of the bead through a seal gasket, said stems of the aerosol valves projecting outwardly through the cover;

a plurality of inner bags which can vary capacity of liquid contents filled therein;

wherein an aerosol propellant is filled in the aerosol container and each inner bag is connected to a respective one of the plurality of aerosol valves, wherein a top end projecting portion of the mounting member is in a substantially elliptical shape, wherein the substantially elliptical shape has alternatively (i) parallel flat side walls; (ii) a flat side wall and a curved side wall; or (iii) two curved side walls, and wherein the stem of each of the plurality of aerosol valves is distinguishable from outside.

2. An aerosol device as defined in claim 1 wherein the aerosol device has two of the aerosol valves and the liquid contents consist of a hair dye which comprises a first agent and a second agent, and a first pouch constituting a first of the plurality of inner bags filled with the first agent is connected to one of the aerosol valves and a second pouch constituting a second of the plurality of inner bags filled with the second agent is connected to the other of the aerosol valves.

3. An aerosol device as defined in claim 1 wherein a reinforcing cover member which is capable of holding the stem gasket and preventing deformation of the cover is provided between the mounting member and the cover.

4. An aerosol device as defined in claim 3 wherein a holding member holds the reinforcing cover member to the mounting member.

5. An aerosol device as defined in claim 3 or 4 wherein the reinforcing cover member covers the top end projecting portion.

6. An aerosol device as defined in claim 5 wherein the reinforcing cover member is provided with a bottom portion which covers the mounting member.

* * * * *